US006299433B1

(12) United States Patent
Gauba et al.

(10) Patent No.: US 6,299,433 B1
(45) Date of Patent: Oct. 9, 2001

(54) BURNER CONTROL

(75) Inventors: Gautam Gauba, Marlborough, MA (US); Charles Edward Benson, Windham, NH (US); Johannes H. J. Thijssen, Cambridge, MA (US); Stephan Erwin Schmidt, Woburn, MA (US); Scott MacAdam, Cambridge, MA (US)

(73) Assignee: Gas Research Institute, Chicago, IL (US)

( * ) Notice: Subject to any disclaimer, the term of this patent is extended or adjusted under 35 U.S.C. 154(b) by 0 days.

(21) Appl. No.: 09/435,288

(22) Filed: Nov. 5, 1999

(51) Int. Cl.[7] ..... F23N 5/112

(52) U.S. Cl. ..... 431/12; 431/25; 431/75; 431/78

(58) Field of Search ..... 431/12, 75, 78, 431/25, 76, 2

(56) References Cited

U.S. PATENT DOCUMENTS

| | | | |
|---|---|---|---|
| 3,741,166 | 6/1973 | Bailey | 431/23 |
| 4,118,172 | 10/1978 | Noir et al. | 431/12 |
| 4,296,727 | 10/1981 | Bryan | 126/116 |
| 4,298,335 | 11/1981 | Riordan | 431/25 |
| 4,348,169 | 9/1982 | Swithenbank et al. | 431/12 |
| 4,405,299 | 9/1983 | Serber | 431/78 |
| 4,444,551 | 4/1984 | Mueller et al. | 431/25 |
| 4,461,615 | 7/1984 | Inoue | 431/76 |
| 4,474,548 | 10/1984 | Miyanaka et al. | 431/1 |
| 4,501,127 | 2/1985 | Sommers et al. | 62/238.3 |
| 4,507,702 | 3/1985 | Grewe | 361/161 |
| 4,508,501 | 4/1985 | Kühn | 431/2 |
| 4,516,930 | 5/1985 | Dietz | 431/26 |
| 4,533,315 | 8/1985 | Nelson | 431/20 |
| 4,541,407 | 9/1985 | Sommers et al. | 126/39 E |
| 4,545,208 | 10/1985 | Kühn | 60/648 |
| 4,568,266 | 2/1986 | Bonne | 431/76 |
| 4,585,631 | 4/1986 | Pfeiffer | 423/235 |
| 4,588,372 | 5/1986 | Torborg | 431/12 |
| 4,591,337 | 5/1986 | Gillhaus | 432/138 |
| 4,645,450 | 2/1987 | West | 431/12 |

(List continued on next page.)

FOREIGN PATENT DOCUMENTS

| | | |
|---|---|---|
| 195 02 901 | 3/1996 | (DE) . |
| 44 33 425 | 3/1996 | (DE) . |
| 195 02 900 | 8/1996 | (DE) . |
| 195 02 905 | 8/1996 | (DE) . |
| 36 30 177 | 3/1998 | (DE) . |
| 195 24 081 | 1/1999 | (DE) . |
| 0 021 035 | 8/1983 | (EP) . |
| 0 104 586 | 4/1984 | (EP) . |
| 0 352 433 | 1/1990 | (EP) . |
| 0 697 637 | 2/1996 | (EP) . |
| 2 666 401 | 3/1992 | (FR) . |
| 710805 | 6/1954 | (GB) . |
| 1193976 | 6/1970 | (GB) . |
| 52-13139 | 2/1977 | (JP) . |
| 56-157725 | 12/1981 | (JP) . |
| 59-189215 | 10/1984 | (JP) . |
| 59-221519 | 12/1984 | (JP) . |
| 62-258928 | 11/1987 | (JP) . |
| 2-302520 | 12/1990 | (JP) . |
| 3-156209 | 7/1991 | (JP) . |
| 6-42741 | 2/1994 | (JP) . |
| 6-93231 | 5/1998 | (JP) . |
| 8403840 | 7/1986 | (NL) . |
| 81/01605 | 6/1981 | (WO) . |

*Primary Examiner*—James C. Yeung
(74) *Attorney, Agent, or Firm*—Pauley Petersen Kinne & Fejer

(57) ABSTRACT

A method and apparatus for controlling the operation of a burner apparatus are provided via the flame intensity of combustion reaction mixtures of oxidant and fuel gas.

37 Claims, 4 Drawing Sheets

U.S. PATENT DOCUMENTS

| | | | |
|---|---|---|---|
| 4,659,306 | 4/1987 | Altemark et al. | 431/12 |
| 4,662,838 | 5/1987 | Riodan | 431/25 |
| 4,688,547 | 8/1987 | Ballard et al. | 126/116 A |
| 4,695,246 | 9/1987 | Beilfuss et al. | 431/31 |
| 4,729,207 | 3/1988 | Dempsey et al. | 126/112 |
| 4,738,577 | 4/1988 | Schalberger | 414/160 |
| 4,802,142 | 1/1989 | Korsmeier et al. | 366/160 |
| 4,825,198 | 4/1989 | Rolker et al. | 340/605 |
| 4,836,770 | 6/1989 | Geary | 431/46 |
| 4,856,331 | 8/1989 | Roese et al. | 73/268 |
| 4,859,171 | 8/1989 | Altemark et al. | 431/12 |
| 4,886,450 | 12/1989 | Heuss | 432/235 |
| 4,901,567 | 2/1990 | Bertke et al. | 73/272 R |
| 4,927,350 | 5/1990 | Zabielski | 431/12 |
| 4,934,926 | 6/1990 | Yamazaki et al. | 431/12 |
| 4,941,345 | 7/1990 | Altemark et al. | 73/23.2 |
| 4,955,806 | 9/1990 | Grunden et al. | 431/24 |
| 4,960,378 | 10/1990 | Jannemann et al. | 431/114 |
| 4,975,043 | 12/1990 | Katchka et al. | 431/54 |
| 4,982,721 | 1/1991 | Lynch | 126/116 A |
| 5,027,789 | 7/1991 | Lynch | 126/116 A |
| 5,037,291 | 8/1991 | Clark | 431/12 |
| 5,049,063 | 9/1991 | Kishida et al. | 431/78 |
| 5,055,032 | 10/1991 | Altemark et al. | 431/158 |
| 5,073,104 | 12/1991 | Kemlo | 431/12 |
| 5,112,217 | 5/1992 | Ripka et al. | 431/12 |
| 5,158,447 | 10/1992 | Geary | 431/25 |
| 5,158,448 | 10/1992 | Kawasaki et al. | 431/74 |
| 5,169,301 | 12/1992 | Donnelly et al. | 431/20 |
| 5,195,885 | 3/1993 | Medina | 431/25 |
| 5,333,591 | 8/1994 | Korsmeier et al. | 123/527 |
| 5,432,095 | 7/1995 | Forsberg | 436/154 |
| 5,439,374 | 8/1995 | Jamieson | 431/25 |
| 5,472,336 | 12/1995 | Adams et al. | 431/6 |
| 5,472,337 | 12/1995 | Guerra | 431/78 |
| 5,506,569 | 4/1996 | Rowlette | 340/577 |
| 5,534,781 | 7/1996 | Lee et al. | 324/380 |
| 5,548,277 | 8/1996 | Wild | 340/578 |
| 5,549,469 | 8/1996 | Wild et al. | 431/75 |
| 5,556,272 | 9/1996 | Blasko et al. | 431/75 |
| 5,576,626 | 11/1996 | Lo | 324/464 |
| 5,577,905 | 11/1996 | Momber et al. | 431/66 |
| 5,599,180 | 2/1997 | Peters et al. | 431/13 |
| 5,899,683 * | 5/1999 | Nolte et al. | 431/12 |
| 5,971,745 | 10/1999 | Bassett et al. | 431/12 |

* cited by examiner

BURNER CONTROL

BACKGROUND OF THE INVENTION

This invention relates generally to the control of burners, particularly gaseous fuel burners. More particularly, the invention relates to methods and apparatus for the control of such burners based on flame intensity.

Burners wherein a gaseous fuel such as natural gas, methane, propane, butane, ethane or the like, for example, is burned with a combustion oxidant gas such as oxygen, oxygen-enriched air or air, for example, are well known. For example, such gas burners find application in various residential, commercial and industrial combustion or heating assemblies such as those that include furnaces, water heaters, boilers, and the like.

In general, proper or desired operation of such burner apparatus involves responsive controlled operation beyond the mere supplying of fuel and oxidant at fixed flow rates. Unfortunately, such responsive control has to date proven relatively difficult and/or costly to achieve in a manner practical and economical for desired broader based applications.

It has long been recognized that flame intensity associated with the burning of such fuel and oxidant combustion mixtures is influenced by a variety of parameters, such as including firing rate, oxidant to fuel (also sometime referred to herein as "O/F" or, more specifically air to fuel ratio, when referring to systems wherein air is employed as the oxidant source), exact oxidant and fuel compositions, and the thermal environment of the flame, for example. It has also been long recognized that means to measure flame intensity are relatively simple and readily commercially available. In fact, flame intensity is routinely measured in many devices as a means of assuring the occurrence of combustion.

Numerous attempts have been made to apply simple flame intensity sensors to the control of oxidant to fuel ratio. Such a control method would significantly reduce the cost of oxidant to fuel ratio control, which is currently primarily achieved with rather expensive sensors that measure the concentration of oxygen in the exhaust. The simplicity and reduction in cost could open up considerable markets for oxidant to fuel ratio control for which it is currently unaffordable. In addition, since the measurement of flame intensity can be made at an individual burner, it would be possible to control the oxidant to fuel ratio from individual burners. In view thereof, potential applications include residential (e.g., air heating or water heating), commercial (e.g., air heating and boilers), industrial (e.g., furnaces and boilers), and power generation (e.g., boilers and gas turbines), for example. Thus, an invention that would enable such a control system could have considerable economic potential and impact.

Unfortunately, because of the dependency of flame intensity on parameters other than the oxidant to fuel ratio (such as parameters such as firing rate, fuel composition, and thermal environment, for example) it has been generally impossible to achieve oxidant to fuel ratio measurement with these sensors without knowing such other parameters as well.

It has also been recognized that the peak in the curve of flame intensity versus oxidant to fuel ratio generally occurs at the same oxidant to fuel ratio as long as the fuel composition is kept reasonably constant, for example, different compositions of natural gas are generally acceptable. Several measurement and control mechanisms based on this principle have been proposed. Unfortunately, the peak in the curve of flame intensity versus oxidant to fuel ratio typically or generally occurs at slightly or even significantly fuel rich conditions. For most combustion systems, operation under such fuel rich conditions is not desirable and for many combustion systems such operation is unacceptable. Consequently, various control schemes have been proposed that require only occasional operation at such fuel rich conditions, in order to calibrate the system. Unfortunately, application of such control schemes results in the control system not being a closed loop control system, but rather an open loop system with periodic calibrations. Furthermore, for some systems even periodic operation under such fuel rich conditions is unacceptable.

Thus, there is a need and a demand for a method and an apparatus for controlling such burner apparatus which more readily permits the use of relatively simple flame intensity sensors, such as known in the art.

In particular, there is a need and a demand for a relatively simple method and apparatus for the closed loop control of such burner apparatus. In addition, there is a need and a demand for burner apparatus control methods and apparatus which avoid or do not require undesired fuel rich condition operation.

SUMMARY OF THE INVENTION

A general object of the invention is to provide improved burner control.

A more specific objective of the invention is to overcome one or more of the problems described above.

The general object of the invention can be attained, at least in part, through a method for controlling operation of a burner apparatus in which a combustion reaction mixture of a combustion oxidant and a fuel gas are burned. For this burner apparatus, flame intensity values are mathematically transformable to create a parameter R. A plot of R versus oxidant to fuel ratio has a slope M which is independent of the burner apparatus firing rate and which varies relative to oxidant to fuel ratio in a known relationship such that each oxidant to fuel ratio is uniquely associated with a particular M value. In accordance with one preferred embodiment of the invention such method includes burning a first combustion reaction mixture wherein the combustion oxidant and the fuel gas are at a first oxidant to fuel ratio, with a first flame intensity being measured for the first combustion reaction mixture. Such method further includes burning a second combustion reaction mixture wherein the combustion oxidant and the fuel gas are at a second oxidant to fuel ratio and wherein the second oxidant to fuel ratio and the first oxidant to fuel ratio differ in a known relative proportion, with a second flame intensity being measured for the second combustion reaction mixture. The measured first and second flame intensities are mathematically transformed to corresponding parameter values $R_1$ and $R_2$, respectively. Then, using the parameter values $R_1$ and $R_2$, the known relative proportion difference of the first and second oxidant to fuel ratios, and the known relationship by which the parameter R varies relative to oxidant to fuel ratio for the burner apparatus, the second oxidant to fuel ratio associated with the second flame intensity is determined.

In one particular embodiment, such a method additionally includes the step of adjusting the combustion oxidant to fuel gas ratio of the combustion reaction mixture to a desired oxidant to fuel ratio.

In another particular embodiment of the invention, such a method additionally comprises comparing the second oxidant to fuel ratio with a target range of oxidant to fuel ratios and, where the second oxidant to fuel ratio is not within the target range, shutting off the burner apparatus or setting off an alarm.

The prior art has generally failed to provide responsive burner control which is as simple and as inexpensive to practice as has been desired. In particular, the prior art has generally failed to provide burner control that more freely permits application of simple flame intensity sensors to the control of oxidant to fuel ratio in such burner apparatus. Thus, the prior art has generally failed to provide a burner control method and apparatus of desired simplicity and reduced cost and such as may find as wide as desired potential application.

In accordance with one particularly preferred embodiment, the invention further comprehends a method for controlling operation of a premixed gas burner apparatus. In one specific form, such a method includes:

burning a combustion reactant mixture comprising a fuel gas and a combustion oxidant;

monitoring a first degree of ionization ($I_1$) of gases resulting from combustion of the reactant mixture at a first equivalence ratio ($\phi_1$) of the fuel gas and the combustion oxidant;

determining a selected combustion reactant flow parameter ($R_1$) for the reactant mixture at the first degree of ionization, where $R_1=\ln(I_1)$;

varying the combustion reactant flow parameter for the combustion reactant mixture being burned;

monitoring a second degree of ionization ($I_2$) of gases resulting from the combustion of the reactant mixture at a second equivalence ratio ($\phi_2$) of the fuel gas and the combustion oxidant at the varied combustion reactant flow parameter;

determining the corresponding combustion reactant flow parameter ($R_2$) for the reactant mixture at the second degree of ionization, where $R_2=\ln(I_2)$;

determining the log slope (l.s.) where $\text{l.s.}=\ln(I_2/I_1)/\ln(\phi_2/\phi_1)$, where l.s. varies relative to oxidant to fuel ratio in a known relationship and each oxidant to fuel ratio is uniquely associated with a particular l.s.value; and adjusting the selected combustion reactant flow parameter to establish a desired equivalence ratio of the fuel and combustion oxidant being supplied to the burner apparatus.

The invention still further comprehends an apparatus for controlling the operation of a gas burner apparatus in which a fuel gas and a combustion oxidant are burned and in which at least one of the fuel gas and the combustion oxidant is supplied in a regulatable manner. In accordance with one embodiment of the invention, such a control apparatus includes a sensor, means for varying a rate of supply of one of the fuel gas and the combustion oxidant into the burner apparatus and a controller. In particular, the apparatus includes a sensor for sensing a degree of flame intensity resulting from combustion of the fuel gas with the combustion oxidant. The sensor is operably disposed within the burner apparatus and generates a signal representative of the degree of flame intensity of the gases. The controller is operably associated with the sensor and the first means. The controller mathematically transforms flame intensity values to create a corresponding parameter R value which varies relative to oxidant to fuel ratio in a known relationship such that each oxidant to fuel ratio is uniquely associated with a particular R value and a plot of R versus oxidant to fuel ratio has a slope which is independent of the burner apparatus firing rate. The controller emits a first signal to the first means so that the first means varies the rate of supply of one of the fuel gas and the combustion oxidant in response to a sensed degree of flame intensity.

In a particular embodiment of such an apparatus, the controller maintains the oxidant to fuel ratio in the gas burner apparatus within a preselected range between a first and a second R value.

In another particular embodiment of such an apparatus, the controller mathematically transforms a first sensed flame intensity associated with the combustion of a first combustion reaction mixture wherein combustion oxidant and fuel gas are at a first oxidant to fuel ratio and a second sensed flame intensity associated with the combustion of a second combustion reaction mixture wherein combustion oxidant and fuel gas are at a second oxidant to fuel ratio which differs from the first oxidant to fuel ratio in a known relative proportion to corresponding parameter values $R_1$, and $R_2$, respectively. Then, in one specific form of such apparatus and in response to the first signal to the first means, the first means varies the rate of supply of one of the fuel gas and the combustion oxidant to result in a desired oxidant to fuel ratio. In certain preferred embodiments of the invention, the controller continuously maintains the oxidant to fuel ratio in the gas burner apparatus within a preselected range corresponding to the oxidant to fuel ratios associated with parameter values $R_1$ and $R_2$, respectively.

Other objects and advantages will be apparent to those skilled in the art from the following detailed description taken in conjunction with the appended claims and drawings.

DETAILED DESCRIPTION OF THE INVENTION

Figure 1:
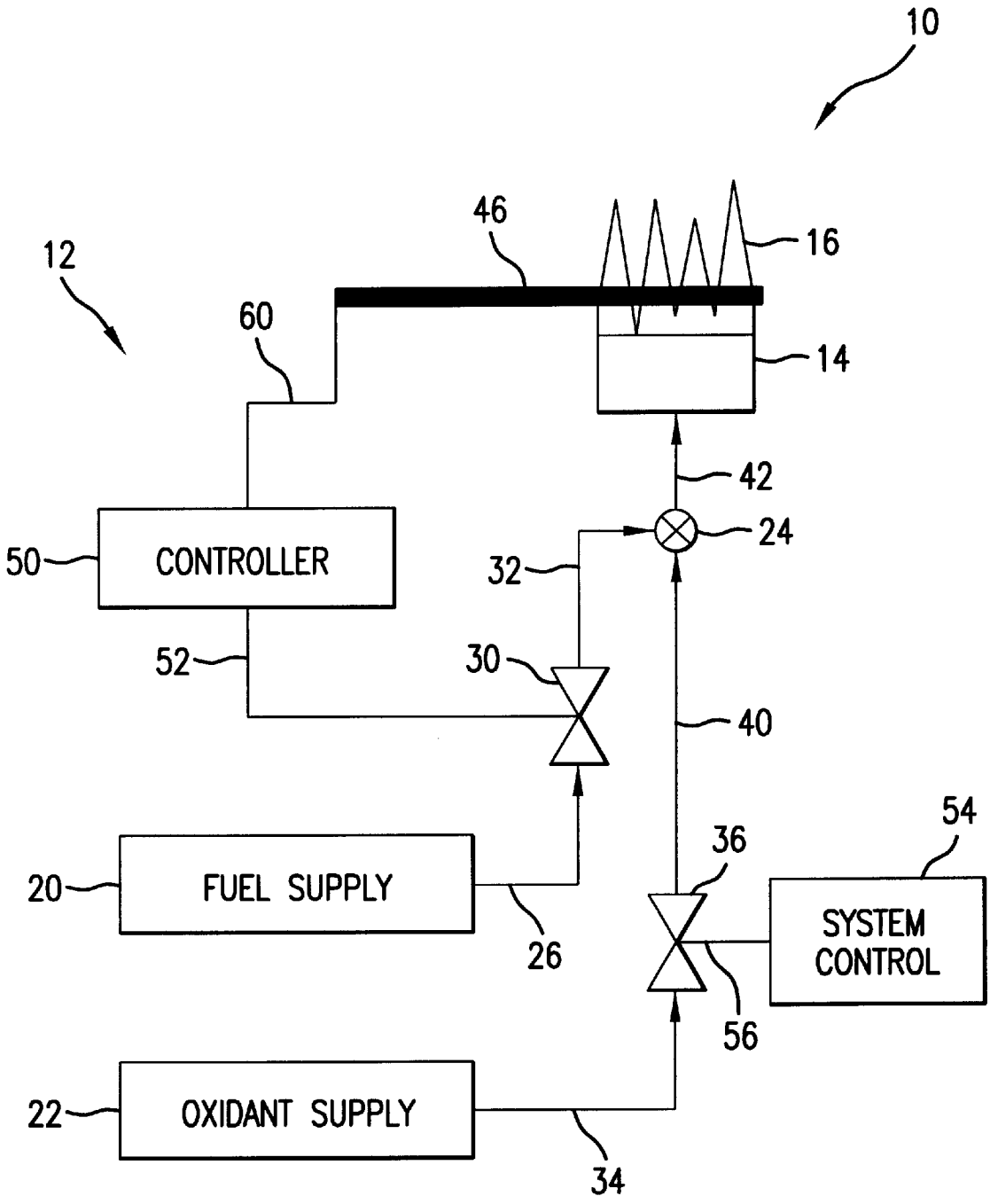
FIG. 1 is a schematic illustration of a burner and associated control apparatus in accordance with one preferred embodiment of the invention.

The invention usefully applies the discovery that, for the practical purpose of the measurement of oxidant to fuel ratios, the curves representing flame intensity versus oxidant to fuel ratio (O/F) have the same shape. Thus, when flame intensity curves representing a variety of firing rates, fuel compositions (within bounds) or thermal environments, for example, are normalized with respect to the maximum flame intensity, such curves will generally overlap.

As will be appreciated by those skilled in the art and guided by the teachings herein provided, there are a variety of ways in which this similarity in the shape of normalized flame intensity values versus oxidant to fuel ratios can be harnessed to provide a reliable parameter that uniquely characterizes each oxidant to fuel ratio value (that is, each value of oxidant to fuel ratio corresponds to only one particular parameter value).

In the practice of the invention, one such useful parameter has been found to be the steepness (or slope) of the normalized curve of flame intensity versus oxidant to fuel ratio. In particular, the steepness of the normalized curve has been found to generally vary monotonically with the oxidant to fuel ratio (from a steep incline, to a peak and then to a steep decline). Thus, if the steepness of the relative curve at the point of operation is known, then the oxidant to fuel ratio is known.

In mathematical terms, this steepness or slope can be expressed as the derivative the flame intensity with respect to the oxidant to fuel ratio:

$$I = f(O/F)$$

$$S = \frac{dI}{d(O/F)}$$

Based on the non-normalized (as measured) curves, the steepness has to be normalized:

$$S_n = \frac{dI}{I * d(O/F)}$$

This parameter can be useful as a measure as it automatically provides the same relationship between $S_n$ and O/F for all curves in the family and therefore $S_n$ provides a unique measure of O/F.

Another parameter that can be used is the slope of the curve of flame intensity versus O/F ratio, in a log-log plot:

$$LS = \frac{d(\ln(I))}{d(\ln(O/F))}$$

The "log slope" describes the normalized shape of the curve, and is independent of firing rate. For a given O/F, the log slope values are essentially the same. An additional benefit of this technique is that it is only necessary to know the relative change in O/F for a measurement.

With this type of measurement concept there are a variety of control algorithms that could be used to implement it. In general, each algorithm involves:

1. A combustion reaction mixture of a fuel gas and a combustion oxidant gas is burned, i.e., a flame is lit. Note, the initial O/F ratio or condition need not be known.
2. The flame intensity is measured.
3. The O/F ratio is perturbed by a known relative amount (i.e., a known percentage). In practice, such a perturbation is typically relatively small or incremental in nature and can be achieved, for example, by modifying the flow rate of at least one of the fuel and the oxidant. In addition, operating parameters such as valve voltages, damper positions, static pressures etc. can, if desired, be used as a surrogate indicator for a respective flow rate.
4. The flame intensity is measured at the perturbed condition.
5. Flame intensity as a function of O/F is normalized. As described above, such normalization may involve the log slope of the curve of flame intensity versus O/F ratio.
6. The controller may then check to determine if the O/F ratio at the perturbed condition is acceptable. If not, the flow rate of the fuel or oxidant reactant actively under control can be changed to achieve the desired O/F ratio.

In accordance with one preferred embodiment of the invention, a log slope control algorithm would consist of the following sequence of steps:

1. Measure flame intensity sensor signal ($I_1$)
2. Measure gas pressure ($P_1$)
3. Step up fuel gas pressure (via a control valve), maintain constant oxidant (e.g., air) flow
4. Measure flame intensity sensor signal ($I_2$) at the stepped up fuel gas pressure
5. Measure the stepped up fuel gas pressure ($P_2$)
6. Calculate "log slope" (l.s.)

$$\text{l.s.}=(\ln(I_2)-\ln(I_1))/(\ln(\phi_2)-\ln(\phi_1)) \text{ or}$$

$$\text{l.s.}=\ln(I_2/I_1)/\ln(\phi_2/\phi_1)$$

where $\phi_2/\phi_1=(P_2/P_1)^{0.5}$ and where $\phi_1$ and $\phi_2$ are the equivalence ratios at $P_1$ and $P_2$, respectively 7. Adjust fuel gas pressure until desired l.s. is attained.

In the sequence above, fuel gas pressure is used as a measure of phi. But oxidant pressure, the position of a fuel gas control valve (such as in the form of valve voltage which is proportional to the gas flow rate) or oxidant damper or the like may be used, if desired.

As will be appreciated by those skilled in the art and guided by the teachings herein provided, the invention provides a desirably simple method and apparatus whereby effective closed loop control of one or more gas burners can be effected. In particular, such closed loop control can be realized by simply reiteration of the steps described above. For example, several iterations of adjusting the flow rate of the fuel or oxidant reactant actively under control and subsequent flame intensity sensing or measuring required in order to arrive at a desired or acceptable O/F.

In accordance with the broader practice of the invention, flame intensity can be measured or evaluated via a variety of different sensors. It is currently believed that those sensors capable of measuring the intensity of combustion in the flame can be used in the practice of the invention. In practice, such intensity of combustion can be expressed in terms of the temperature as well as the concentrations of reactive species that are uniquely formed as intermediate species during the conversion of fuel and oxidant to final products (usually $CO_2$ and $H_2O$ ). Such reactive species can include flame ions, free radicals, and photochemically active species. Specific commonly used sensors that measure these properties may, for example, include with regard to flame temperature, a device such as a thermocouple and, with respect to active species such as flame ions, a flame ionization probe or flame rod and, with respect to photochemically active species, an optical flame scanner (such as a UV scanner, for example) Those skilled in the art and guided by the teachings herein provided will appreciate that suitable flame intensity sensors used in the practice of the invention can appropriately measure or monitor the flame intensity by various techniques such as through current, voltage or resistance, as may be desired.

As described in greater detail below, the invention appears to work especially well with premixed burners (i.e., those burner apparatuses wherein fuel and oxidant are premixed), burners that comprise a well-defined zone in which fuel and oxidant are premixed, or with those burners that include extensions wherein fuel and oxidant are premixed. The invention also appears to generally work best with those burners that utilize a gaseous fuel. Oxidants employed in the practice of the invention can appropriately include those various fluids and mixtures of fluids that contain molecular oxygen. Specific suitable oxidants which can be appropriately used in the practice of particular embodiments of the invention include oxygen, air, vitiated air, air combined with flue-gas and oxygen-enriched air, for example.

Thus, the present invention provides a method and an apparatus for controlling operation of a burner apparatus and the invention is capable of being embodied in a variety of different structures and forms, as will be apparent to those skilled in the art and guided by the teachings herein provided. Thus, the several specific embodiments shown in the drawings and herein described are to be considered as an exemplification of the principles of the invention and the broader practice of the invention is not necessarily limited to such specific embodiments.

As representative, FIG. 1 illustrates a burner appliance apparatus, generally designated by the reference numeral 10, employing a burner control system 12 in accordance with one embodiment of the invention. More specifically, the burner appliance apparatus 10 includes a burner 14 such as produces a flame 16. The burner appliance apparatus 10 also includes a fuel gas supply or source 20 and an oxidant supply or source 22 appropriately joined or connected with the burner 14, such as via a mixing device or chamber 24 wherein the fuel gas and oxidant gas can be appropriately premixed prior to entry into the burner 14. In particular, fuel gas is conveyed from the fuel gas supply 20 via a conduit 26 through a modulating fuel gas flow control valve 30 and then via a conduit 32 to the mixing device 24. Oxidant gas is correspondingly conveyed from the oxidant gas supply 22 via a conduit 34 through a modulating oxidant gas flow control valve 36 and then via a conduit 40 to the mixing device 24. A conduit 42 operatively conveys the premixed fuel and oxidant from the mixing device 24 to the burner 14.

It will be appreciated that, in the broader practice of the invention, the mixing may alternatively or additionally occur in the burner or in a mixing chamber contiguous with the burner, as may be desired.

The burner control system 12 includes a flame sensor 46 and a controller 50 (such as in the form of a microprocessor or computer, for example) operatively connected to the modulating fuel gas flow control valve 30, as shown by the control signal line 52.

The burner appliance apparatus 10 also includes, either as a part of the burner control system 12 or separately, a system controller 54 operatively connected to the modulating oxidant supply flow control valve 36, as shown by the control signal line 56.

More specifically, the burner control system 12 employs a flame sensor 46, which may be of known design, mounted operably with the burner 14 to permit the sensing of the flame intensity, such as described above.

User input (such as in the form of the output 56 from the system control 54, which may come from a thermostat, such as in the case of a furnace or other HVAC appliance, or a temperature control knob, such as in the case of cooking appliance), will tend to be an instruction of the form that the burner should attain a desired firing rate or temperature.

An output 60 of the sensor 46 is fed to the controller 50. The controller 50, in turn, communicates, via the control signal line 52 with the fuel gas flow control valve 30 such as to maintain or alter, i.e., increase or decrease, the relative flow of the fuel gas or combustion air, such as indicated upon application of the above-described log slope control algorithm thereto.

Figure 2:
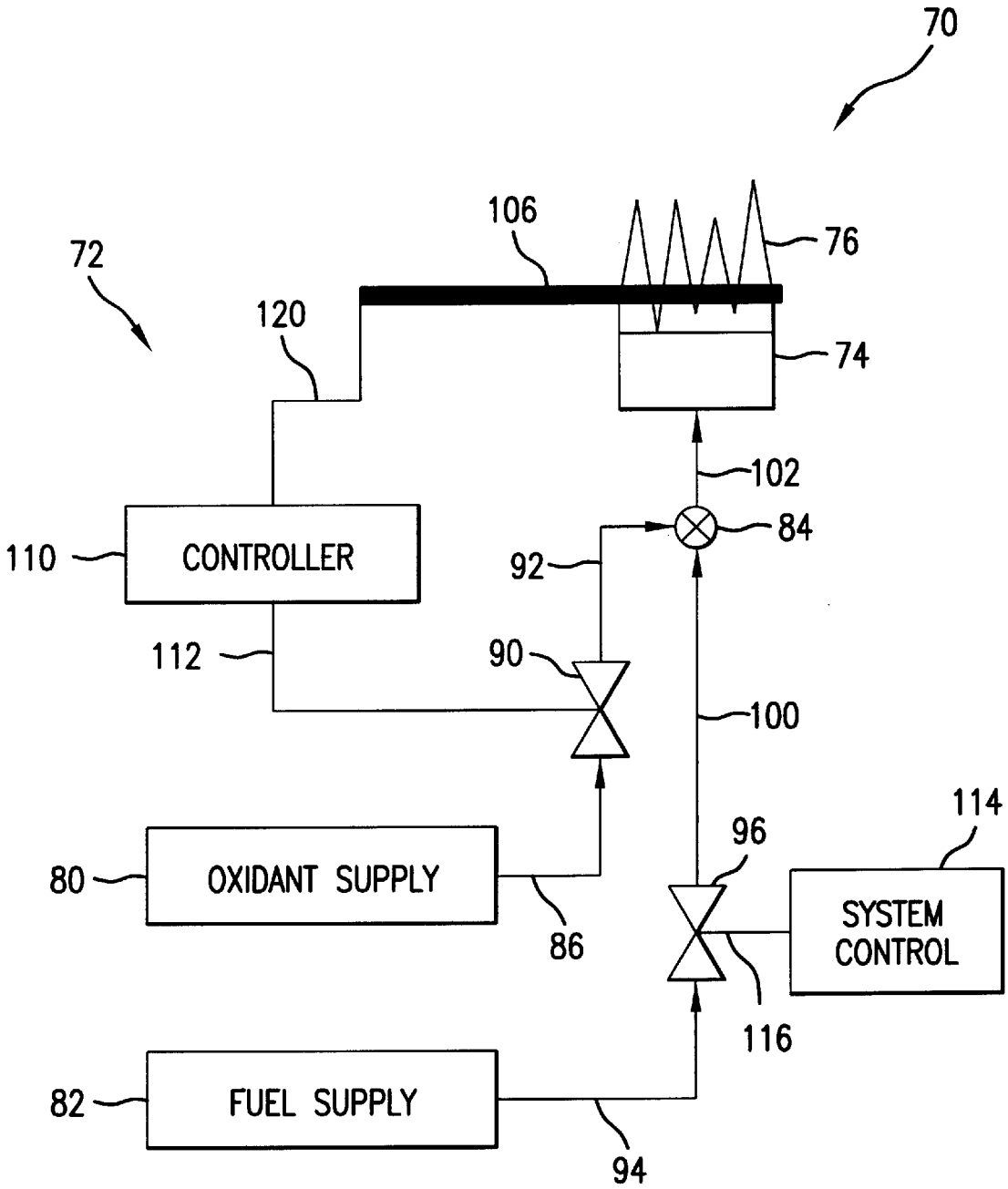
FIG. 2 is a schematic illustration of a burner and associated control apparatus in accordance with another preferred embodiment of the invention.

FIG. 2 illustrates a burner appliance apparatus, generally designated by the reference numeral 70, employing a burner control system 72 in accordance with one embodiment of the invention. More specifically, the burner appliance apparatus 70 includes a burner 74 such as produces a flame 76. The burner appliance apparatus 70 also includes an oxidant supply or source 80 and a fuel gas supply or source 82 appropriately joined or connected with the burner 74, such as via a mixing device or chamber 84 wherein the fuel gas and oxidant gas can be appropriately premixed prior to entry into the burner 74. In particular, oxidant gas is conveyed from the oxidant supply 80 via a conduit 86 through a modulating oxidant flow control valve 90 and then via a conduit 92 to the mixing device 84. Fuel gas is correspondingly conveyed from the fuel gas supply 82 via a conduit 94 through a modulating fuel gas flow control valve 96 and then via a conduit 100 to the mixing device 84. A conduit 102 operatively conveys the premixed fuel and oxidant from the mixing device 84 to the burner 74.

The burner control system 72 includes a flame sensor 106 and a controller 110 (such as in the form of a microprocessor or computer, for example) operatively connected to the modulating oxidant flow control valve 90, as shown by the control signal line 112.

The burner appliance apparatus 70 also includes, either as a part of the burner control system 72 or separately, a system controller 114 operatively connected to the modulating fuel gas flow control valve 96, as shown by the control signal line 116.

Similar to the above-described burner appliance apparatus 10, shown in FIG. 1, the burner control system 72 employs a flame sensor 106, such as of known design, mounted in burner flame intensity transmitting relationship with the burner 74. User input (such as in the form of the output 116 from the system control 114, such as described above), will tend to be an instruction of the form that the burner should attain a desired firing rate or temperature.

An output 120 of the sensor 106 is fed to the controller 110. The controller 110, in turn, communicates, via the control signal line 112 with the oxidant flow control valve 90 such as to maintain or alter, i.e., increase or decrease, the relative flow of the oxidant to the fuel gas, such as indicated upon application of the above-described log slope control algorithm thereto.

Figure 3:
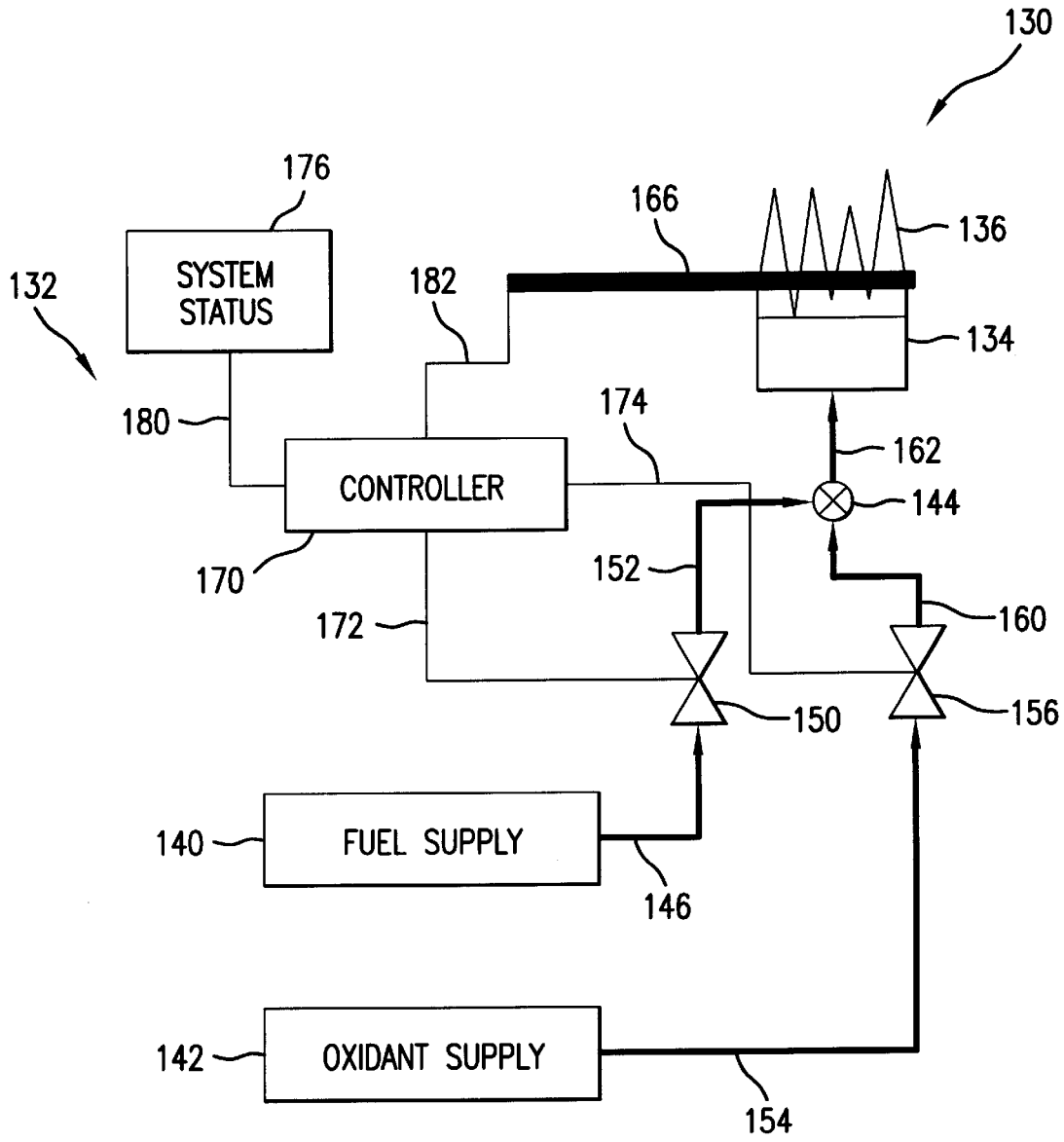
FIG. 3 is a schematic illustration of a burner and associated control apparatus in accordance with yet another preferred embodiment of the invention.

FIG. 3 illustrates a burner appliance apparatus, generally designated by the reference numeral 130, in accordance with yet another alternative embodiment of the invention and which apparatus 130 employs an integrated burner control system 132. More specifically, the burner appliance apparatus 130 includes a burner 134 such as produces a flame 136. The burner appliance apparatus 130 includes a fuel gas supply or source 140 and an oxidant supply or source 142, each appropriately joined or connected with the burner 134, such as via a mixing device or chamber 144 wherein the fuel gas and oxidant gas can be appropriately premixed prior to entry into the burner 134.

In particular, the fuel gas is conveyed from the fuel gas supply 140 via a conduit 146 through a modulating fuel gas flow control valve 150 and then via a conduit 152 to the mixing device 144. Similarly, the oxidant gas is conveyed from the oxidant supply 142 via a conduit 154 through a modulating oxidant flow control valve 156 and then via a conduit 160 to the mixing device 144. A conduit 162 operatively conveys the premixed fuel and oxidant from the mixing device 144 to the burner 134.

The integrated burner control system 132 includes a flame sensor 166 and a controller 170, such as in the form of a microprocessor or computer, for example. The controller 170 is operatively connected to each of the modulating fuel gas flow control valve 150 and the oxidant flow control valve 156, as shown by the control signal lines 172 and 174, respectively.

A system status, such as designated by the reference numeral 176, is operatively connected or joined to or with the controller 170, to provide an input designated by the reference numeral 180, thereto.

Similar to the above-described burner appliance apparatuses 10 and 70, shown in FIGS. 1 and 2, respectively, the flame sensor 166, such as of known design is mounted in burner flame intensity transmitting relationship with the burner 134. An output 182 of the sensor 166 is fed to the controller 110. The controller 110, in turn, communicates, via either or both the control signal lines 172 and 174 with the fuel gas control valve 150 and the oxidant flow control valve 156 such as to maintain or alter, i.e., increase or decrease, the relative flow of the oxidant to the fuel gas, such as indicated upon application of the above-described log slope control algorithm thereto.

The present invention is described in further detail in connection with the following examples which illustrate or simulate various aspects involved in the practice of the invention. It is to be understood that all changes that come within the spirit of the invention are desired to be protected and thus the invention is not to be construed as limited by these examples.

EXAMPLES

In accordance with the invention, the oxidant/fuel ratio for a combustion reaction mixture of an oxidant and a fuel gas can be monitored by measuring the signal from a flame ionization sensor (FIS) or the like. A suitable flame ionization sensor is typically in the form of an electrode made of a conductive material that is capable of withstanding high temperatures and temperature gradients.

Hydrocarbon flames conduct electricity because charged species (positive and negative ions and free electrons) are formed in the flame. Thus, placing a voltage across such a flame sensor and associated flame holder causes a current to flow when a flame closes the circuit. The magnitude of the current (sensor signal) is related to the ion concentration in the flame. The total ion concentration is primarily a function of flame temperature, which in turn is a function of the oxidant to fuel ratio.

Figure 4:
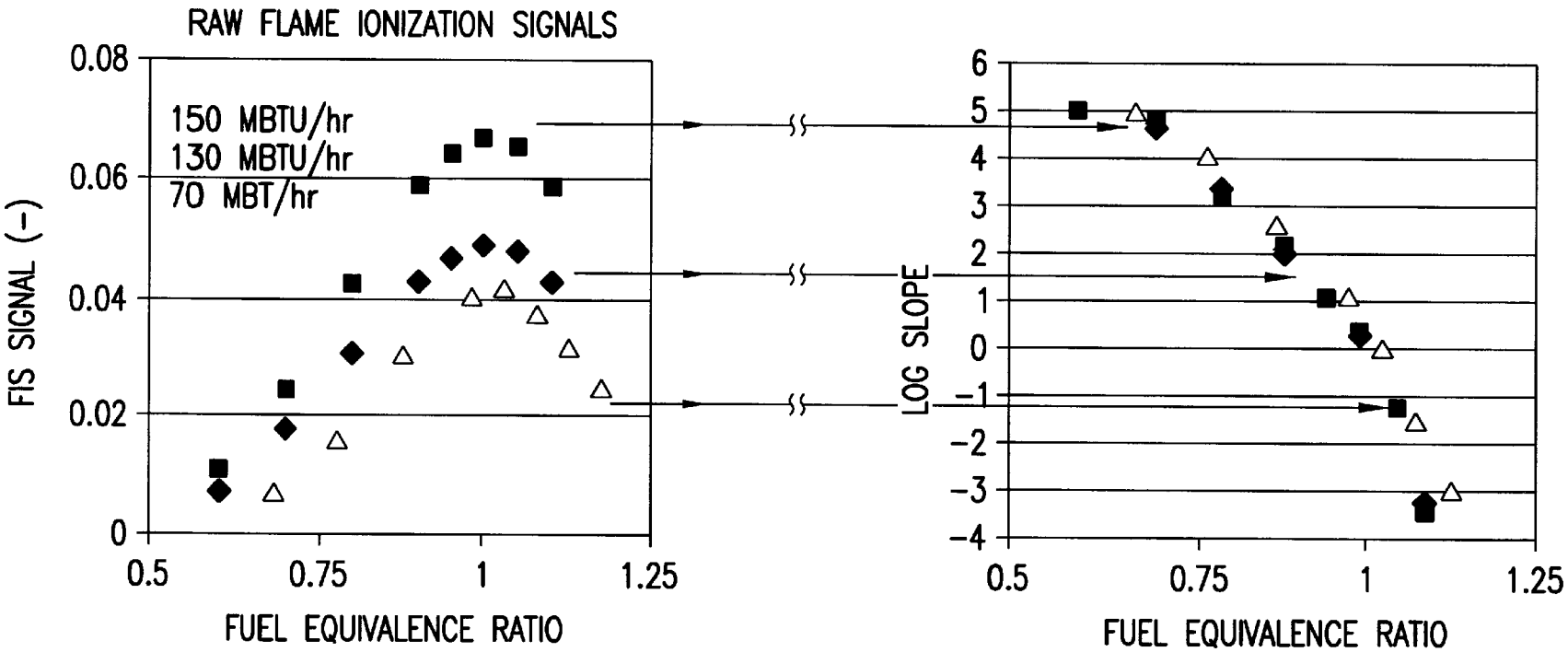
FIG. 4 illustrates raw flame ionization signals obtained in a residential premixed natural gas-fueled burner at three selected firing rates, i.e., 70 MBTU/hr; 130 MBTU/hr; and 150 MBTU/hr, respectively, and FIG. 4' illustrates these flame ionization signals projected onto a single normalized quantity that declines monotonically with the equivalence ratio, in accordance with the invention.

FIG. 4 illustrates the raw flame ionization signals obtained in a residential premixed natural gas-fueled burner at three selected firing rates, i.e., 70 MBTU/hr; 130 MBTU/hr; and 150 MBTU/hr, respectively. FIG. 4' illustrates these flame ionization signals projected onto a single normalized quantity that declines monotonically with the equivalence ratio via the employment of the log slope algorithm, described above.

As will be appreciated, the invention, such as via the "log slope" approach described above, can provide instantaneous or near instantaneous measurement, and allow more complete flexibility in profiling oxidant to fuel ratios as a function of firing rate. It will be understood that application of the log slope approach, as described above, will generally require that some measure of pressure (of either air or fuel gas) or the fuel or air valve or damper position for the burner apparatus be available to allow calculation of the derivative. The technique of the invention may advantageously be used in various premixed burner applications, including residential water heaters, commercial make-up air units and in industrial burners where premixed control pilots are used.

In addition, the method and apparatus of the invention can advantageously be applied to gas burner apparatus employing propane or butane gas as a fuel gas. In particular, the technique of the invention such as exemplified by the log slope technique is particularly useful in the case of propane flames. Unlike natural gas flames, whose ionization signals peak at a $\phi$ of 1, propane flames peak at a $\phi$ of 1.3–1.4. Consequently, control of a propane burning burner apparatus via application of a peak seeking control technique generally undesirably necessitates operation in a fuel rich regime for at least certain periods of time. With the invention, however, the necessity of operation at such fuel rich conditions can be practically and beneficially avoided.

As will be appreciated, the subject invention can be appropriately applied in various combustion applications. The invention, however, is believed to have particular utility in those applications which utilize premixed or partially premixed burners. In those applications where non-premixed combustion is preferred, the invention can be desirably practiced by fashioning a part of the burner to afford a premixed zone, with an O/F ratio directly proportional to that of the main burner.

Particular examples of specific contemplated applications for the practice of the invention include:

1.) Residential combustion equipment. In typical residential combustion equipment hardly any O/F control is used. In general, residential combustion units employ a fixed firing rate with a preset oxidant to fuel ratio. Practice of the invention in conjunction with residential combustion equipment permits various benefits such as those relating to improved emissions and safety and reduced installation cost to be realized as, for example, factors such as fuel gas quality and altitude of the installation can be addressed without requiring changes in hardware. While residential combustion units do not commonly employ premixed burners, modification of such equipment such as through the incorporation of suitable burner and fuel gas- or oxidant air-control actuators may permit the ready practice of the invention in conjunction therewith. In addition, the invention can serve to further enable the use of premixed burners, which can provide significant benefits in efficiency and emissions control in certain applications. Also, as modulation of residential equipment is becoming of increasing interest because of comfort benefits, the more complete implementation of the invention can be facilitated and the benefits resulting therefrom increased 2.) Commercial heating equipment. A large portion of the commercial heating equipment market is either not modulated or employs a two-level control. However, similar benefits to those described above in connection with residential applications can also be realized in such commercial applications. In addition, since more fuel gas is generally consumed in such commercial applications, the efficiency benefits (e.g., fuel savings) can be particularly significant in such applications. Further, as emissions regulations are generally more strict in the commercial environment, the emission benefits obtainable through the practice of the invention can be even more pronounced in such commercial applications. Further, some commercial heating equipment is direct fired (i.e., combustion products are mixed with the heated air, such as in direct fired make-up air units). In such applications, extremely large turndown ratios are required. Thus, practice of the invention in such applications may more readily enable the use of premixed burners (instead of diffusion flame burners without O/F control) and ensure that indoor air quality standards are satisfied. Further, commercial boilers typically employ non-premixed boilers that are modulated over a 4:1 turndown range. Such systems typically employ open-loop mechanical or pneumatic linkages to effect a form of"O/F control." Moreover, in high-end systems, expensive $O_2$-sensor-based closed loop systems are commonly utilized. Practice of the invention in conjunction with commercial boilers may advantageously provide all the benefits described for residential equipment with the added benefits of increased savings in annual maintenance and, for larger systems, considerable fuel savings.

3.) Industrial heating equipment. Most industrial systems employ similar technology to that used in commercial boilers. In addition, industrial furnaces commonly utilize a multitude of burners. In order to provide desired process conditions and better ensure reduced emissions of incomplete combustion reaction products, it is desirable that such burners be operated in balance (i.e., the burners are synchronously operated). Unfortunately, there is currently no generally available technology whereby such operation can be achieved. Thus, such application of the invention can serve to improve process conditions and reduce emissions of incomplete combustion reaction products. While some industrial applications utilize premixed burners, in general, burner modifications may be required to employ the invention in those of such applications not employing premixed burners.

4.) Utility boilers. In general, practice of the invention in such applications permits realization of benefits similar to those described above relative to industrial heating equipment. Moreover, as the fuel consumption per burner in such applications can be extremely large, correspondingly large reductions in fuel consumption and undesirable emissions can also be realized through such application of the invention.

5.) Gas turbines. While the use of premixed systems is becoming more and more prevalent in gas turbines in order to reduce emissions, precise burner by burner control of the air fuel ratio is currently not feasible. Thus, such application of the invention may desirably satisfy one of the more significant technical challenges to the employment of such gas turbines of high efficiency and very low emissions.

As will be appreciated, closed loop control such as obtainable through practice of the subject invention permits operation at lower excess-air levels such as may desirably result in increased operating efficiencies and associated reductions in fuel consumption. In addition, closed loop control desirably permits operation within a range of optimum O/F ratios that minimize undesired emissions.

The invention may alternatively or additionally be practiced or employed in monitoring burner operation. For example, a determined oxidant to fuel ratio can be compared to a target range of oxidant to fuel ratios and, where the determined oxidant to fuel ratio is not within the target range, shutting off the burner apparatus or setting off an appropriate alarm.

Thus, the invention provides responsive burner control such as may appropriately be either or both simpler and less expensive to practice than previously possible. In particular, the invention provides burner control that more freely permits application of simple flame intensity sensors to the control of oxidant to fuel ratio in such burner apparatus. Thus, the invention may generally provide burner control methods and apparatus of desired simplicity and reduced cost and such as may find wider potential application than obtainable via prior methods and apparatus.

The invention illustratively disclosed herein suitably may be practiced in the absence of any element, part, step, component, or ingredient which is not specifically disclosed herein.

While in the foregoing detailed description this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

What is claimed is:

1. A method for controlling operation of a burner apparatus in which a combustion reaction mixture of a combustion oxidant and a fuel gas are burned, the method comprising:

burning a first combustion reaction mixture in the burner apparatus wherein the combustion oxidant and the fuel gas are at a first oxidant to fuel ratio;

measuring a first flame intensity for the first combustion reaction mixture;

burning a second combustion reaction mixture in the burner apparatus wherein the combustion oxidant and the fuel gas are at a second oxidant to fuel ratio, wherein the second oxidant to fuel ratio and the first oxidant to fuel ratio differ in a known relative proportion;

measuring a second flame intensity for the second combustion reaction mixture, wherein neither the first flame intensity nor the second flame intensity occurs at a peak in a plot of flame intensities versus oxidant to fuel ratios for the burner apparatus;

mathematically transforming the measured first and second flame intensities to corresponding parameter values $R_1$ and $R_2$, respectively, with a plot of values of the parameter R versus oxidant to fuel ratio forming a curve having a slope M and a shape which are independent of the burner apparatus firing rate and which slope M varies relative to oxidant to fuel ratio in a known relationship such that, for the burner apparatus, each oxidant to fuel ratio is uniquely associated with a particular M value; and using the parameter values $R_1$ and $R_2$, the known relative proportion difference of the first and second oxidant to fuel ratios, and the known relationship by which the parameter R varies relative to oxidant to fuel ratio for the burner apparatus, determining the second oxidant to fuel ratio associated with the second flame intensity.

2. The method of claim I additionally comprising the step of:

adjusting the combustion oxidant to fuel gas ratio of the combustion reaction mixture to a desired oxidant to fuel ratio.

3. The method of claim 1 additionally comprising the steps of:

comparing the second oxidant to fuel ratio with a target range of oxidant to fuel ratios and, where the second oxidant to fuel ratio is not within the target range, shutting off the burner apparatus or setting off an alarm.

4. The method of claim 1 wherein at least one of the first and second flame intensities is measured as a function of temperature.

5. The method of claim 1 wherein at least one of the first and second flame intensities is measured as a function of reactive species formed upon combustion of the first and second combustion reaction mixtures, respectively.

6. The method of claim 1 wherein at least one of the first and second flame intensities is measured as a function of flame ions formed upon combustion of the first and second combustion reaction mixtures, respectively.

7. The method of claim 1 wherein at least one of the first and second flame intensifies is measured as a function of free radicals formed upon combustion of the first and second combustion reaction mixtures, respectively.

8. The method of claim 1 wherein at least one of the first and second flame intensities is measured as a function of photochemically active species formed upon combustion of the first and second combustion reaction mixtures, respectively.

9. The method of claim 1 wherein at least one of the first and second flame intensities is measured in a form selected from the group of current, voltage and resistance.

10. The method of claim 1 wherein at least one of the first and second flame intensities is measured as a function of fuel gas pressure.

11. The method of claim 1 wherein at least one of the first and second flame intensities is measured as a function of combustion oxidant pressure.

12. The method of claim 1 wherein the gas burner apparatus comprises a fuel gas control valve having a selectable position corresponding to the fuel gas flow therethrough, wherein at least one of the first and second flame intensities is measured as a function of the position of the fuel gas control valve.

13. The method of claim 1 wherein the gas burner apparatus comprises an oxidant damper having a selectable position corresponding to the combustion oxidant flow therethrough, wherein at least one of the first and second flame intensities is measured as a function of the position of the oxidant damper.

14. The method of claim 1 wherein the fuel gas is natural gas.

15. The method of claim 1 wherein the fuel gas comprises propane.

16. The method of claim 1 wherein the fuel gas consists essentially of propane.

17. The method of claim 1 wherein the fuel gas comprises butane.

18. A method for controlling operation of a premixed gas burner apparatus, the method comprising:

burning a combustion reactant mixture comprising a fuel gas and a combustion oxidant;

monitoring a first degree of ionization ($I_1$) of gases resulting from combustion of the reactant mixture at a first equivalence ratio ($\phi_1$) of the fuel gas and the combustion oxidant;

determining a selected combustion reactant flow parameter ($R_1$) for the reactant mixture at the first degree of ionization, where $R_1=\ln(I_1)$;

varying the combustion reactant flow parameter for the combustion reactant mixture being burned;

monitoring a second degree of ionization ($I_2$) of gases resulting from the combustion of the reactant mixture at a second equivalence ratio ($\phi_2$) of the fuel gas and the combustion oxidant at the varied combustion reactant flow parameter;

determining the corresponding combustion reactant flow parameter ($R_2$) for the reactant mixture at the second degree of ionization, where $R_2=\ln(I_2)$;

determining the log slope (l.s.) where l.s.$=\ln(I_2/I_1)\ \ln(\phi_2/\phi_1)$, where l.s. varies relative to oxidant to fuel ratio in a known relationship and each oxidant to fuel ratio is uniquely associated with a particular l.s.value; and adjusting the selected combustion reactant flow parameter to establish a desired equivalence ratio of the fuel and combustion oxidant being supplied to the burner apparatus.

19. The method of claim 18 wherein the selected combustion reactant flow parameter is fuel gas pressure.

20. The method of claim 18 wherein the selected combustion reactant flow parameter is combustion air pressure.

21. The method of claim 18 wherein the gas burner apparatus comprises a fuel gas control valve having a selectable position corresponding to the fuel gas flow therethrough, wherein the selected combustion reactant flow parameter is the position of the fuel gas control valve.

22. The method of claim 18 wherein the gas burner apparatus comprises a n air damper having a selectable position corresponding to the combustion air flow therethrough, wherein the selected combustion reactant flow parameter is the position of the air damper.

23. The method of claim 18 wherein the fuel gas is natural gas.

24. The method of claim 18 wherein the fuel gas comprises propane.

25. The method of claim 18 wherein the fuel gas consists essentially of propane.

26. The method of claim 18 wherein the fuel gas comprises butane.

27. An apparatus for controlling the operation of a gas burner apparatus in which a fuel gas and a combustion oxidant are burned and in which at least one of the fuel gas and the combustion oxidant is supplied in a regulatable manner, the control apparatus comprising:

a sensor for sensing a degree of flame intensity resulting from combustion of the fuel gas with the combustion oxidant, the sensor operably disposed within the burner apparatus and generating a signal representative of the degree of flame intensity of the gases;

first means for varying a rate of supply of one of the fuel gas and the combustion oxidant into the burner apparatus; and a controller operably associated with the sensor and the first means, the controller mathematically transforming flame intensity values to create a corresponding parameter R value which varies relative to oxidant to fuel ratio in a known relationship such that each oxidant to fuel ratio is uniquely associated with a particular R value and a plot of R versus oxidant to fuel ratio has a slope which is independent of the burner apparatus firing rate, the controller emitting a first signal to the first means so that the first means varies the rate of supply of one of the fuel gas and the combustion oxidant in response to a sensed degree of flame intensity.

28. The apparatus of claim 27 wherein the controller maintains the oxidant to fuel ratio in the gas burner apparatus within a preselected range between a first and a second R value.

29. The apparatus of claim 27 wherein the controller mathematically transforms a first sensed flame intensity associated with the combustion of a first combustion reaction mixture wherein combustion oxidant and fuel gas are at a first oxidant to fuel ratio and a second sensed flame intensity associated with the combustion of a second combustion reaction mixture wherein combustion oxidant and fuel gas are at a second oxidant to fuel ratio which differs from the first oxidant to fuel ratio in a known relative proportion to corresponding parameter values $R_1$ and $R_2$, respectively.

30. The apparatus of claim 29 wherein in response to the first signal to the first means, the first means varies the rate of supply of one of the fuel gas and the combustion oxidant to result in a desired oxidant to fuel ratio.

31. The apparatus of claim 30 wherein the controller continuously maintains the oxidant to fuel ratio in the gas burner apparatus within a preselected range corresponding to the oxidant to fuel ratios associated with parameter values $R_1$ and $R_2$, respectively.

32. The apparatus of claim 27 wherein the sensor for sensing a degree of flame intensity resulting from combustion of the fuel gas with the combustion oxidant comprises a temperature sensing device.

33. The apparatus of claim 32 wherein the sensor for sensing a degree of flame intensity resulting from combustion of the fuel gas with the combustion oxidant comprises a thermocouple.

34. The apparatus of claim 27 wherein the sensor for sensing a degree of flame intensity resulting from combustion of the fuel gas with the combustion oxidant comprises a flame ionization probe.

35. The apparatus of claim 27 wherein the sensor for sensing a degree of flame intensity resulting from combustion of the fuel gas with the combustion oxidant measures such flame intensity in a form selected from the group of current, voltage and resistance.

36. The apparatus of claim 27 wherein the sensor for sensing a degree of flame intensity resulting from combustion of the fuel gas with the combustion oxidant comprises an optical scanner.

37. The apparatus of claim 36 wherein the optical scanner comprises a UV scanner.

* * * * *